United States Patent [19]

Prince et al.

[11] 4,035,847

[45] July 19, 1977

[54] SUSPENSION FOR A HARD HAT

[75] Inventors: Jack M. Prince, West Reading, Pa.; Dai Chung Yang, Wilmington, Del.

[73] Assignee: The Fibre-Metal Products Co., Concordville, Pa.

[21] Appl. No.: 702,105

[22] Filed: July 2, 1976

[51] Int. Cl.[2] ..... A42B 3/02

[52] U.S. Cl. ..... 2/416

[58] Field of Search ..... 2/420, 410, 418, 416

[56] References Cited

U.S. PATENT DOCUMENTS

| | | | |
|---|---|---|---|
| 3,026,523 | 3/1962 | Bowers et al. | 2/416 |
| 3,268,911 | 8/1966 | Cox | 2/416 |
| 3,422,459 | 1/1969 | Bowers | 2/416 |
| 3,909,846 | 10/1975 | Zahn | 2/416 |

*Primary Examiner*—Alfred R. Guest
*Attorney, Agent, or Firm*—Robert K. Youtie

[57] ABSTRACT

A hard hat suspension which includes a group of highly curved, narrow and transversely thick suspension legs and a second group of slightly curved, wide and transversely thin suspension legs in angularly spaced relation, arranged so that the more yieldable highly curved suspension legs are initially distended and come into operation upon the application of external force to the hat shell, as by impact from a falling object, before the less yieldable, slightly curved suspension legs come into operation. While the instant suspension is of normally elastic plastic material, which materials become brittle at low temperatures, the highly curved suspension legs are capable of straightening or "uncoiling" even when brittle without breaking to absorb energy and spread load between the highly curved legs without effective operation of the slightly curved legs.

At elevated temperatures, both groups of suspension legs will become relatively soft and plastic upon impact of the shell by a falling object, the highly curved legs uncoiling or straightening rapidly until the entire suspension has all suspension legs in operation absorbing and distributing the shock.

7 Claims, 7 Drawing Figures

SUSPENSION FOR A HARD HAT

BACKGROUND OF THE INVENTION

As is well known to those versed in the art, there have been provided a wide variety of hard hat suspensions for softening forces transmitted through the hard hat shell to the wearer's head. However, such prior devices have not been entirely satisfactory, for example in lacking satisfactory force transmission characteristics throughout a wide range of environmental temperatures, tending to transmit force with undue components of shock, and failing to effect balanced distribution of transmitted force.

SUMMARY OF THE INVENTION

It is, therefore, an important object of the present invention to provide a suspension for a hard hat which overcomes the above-mentioned difficulties, affords highly satisfactory use and operation throughout an extremely wide range of environmental temperature, affords a high degree of shock component dissipation for relatively gradual increase in force transmission to the wearer's head, and wherein any force transmitted is uniformly distributed and balanced to prevent undue force localization.

It is still another object of the present invention to provide a hard hat suspension having the advantageous characteristics mentioned in the preceding paragraph, which is capable of economic mass production and assembly in a hard hat to achieve substantial economies and permit sale at a reasonable price, the suspension being of integral formation for molding by automatic equipment, and which is extremely durable and reliable throughout a long useful life and under highly abusive conditions of use.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figure 1:
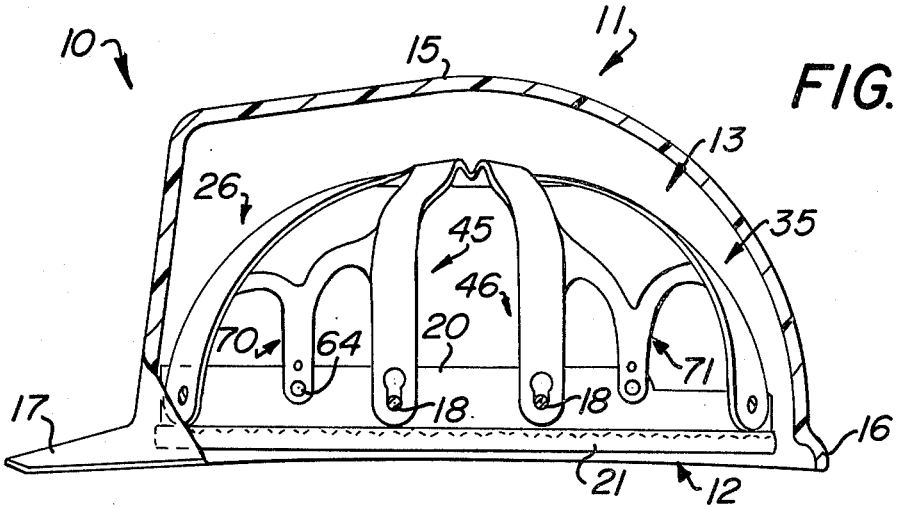
FIG. 1 is a longitudinal sectional elevational view showing a hard hat including a suspension constructed in accordance with the teachings of the present invention.
Figure 2:
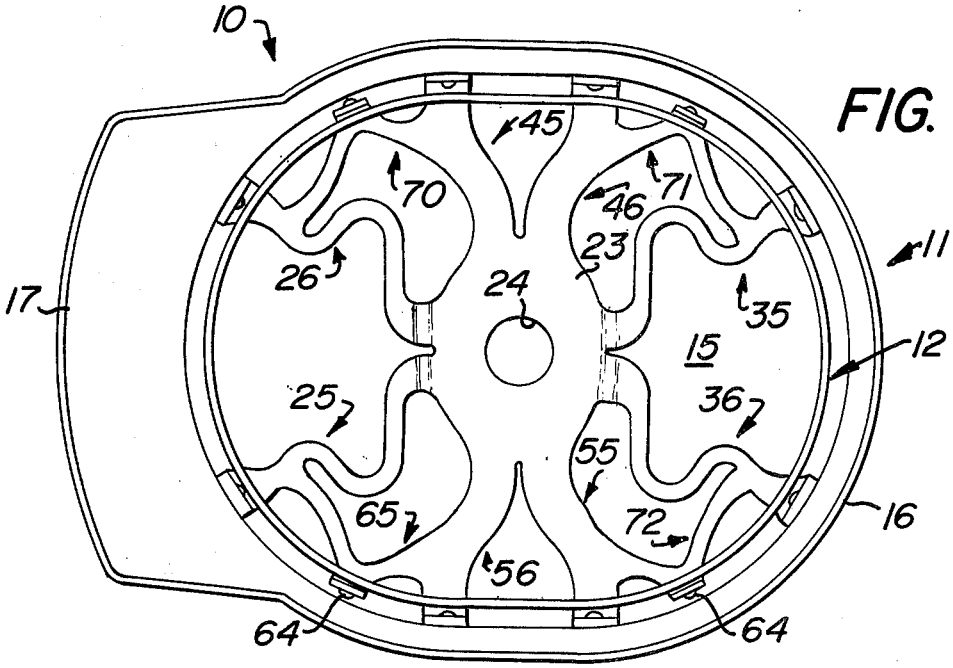
FIG. 2 is a bottom view showing the hard hat of FIG. 1.
Figure 7:
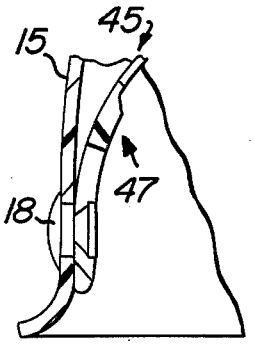
FIG. 7 is a sectional elevational view taken generally along the line 7—7 of FIG. 6.
Figure 6:
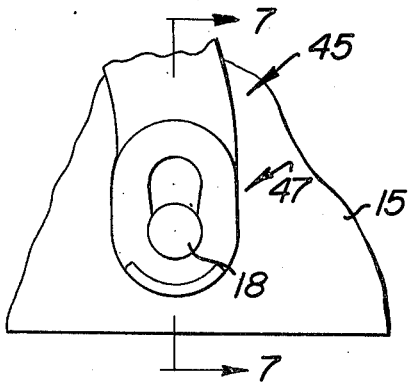
FIG. 6 is a partial internal elevational view of the instant hard hat, illustrating one mode of connecting the suspension to the hat shell.

Referring now more particularly to the drawings, and specifically to FIGS. 1 and 2 thereof, an industrial cap or hard hat is there generally designated 10, and includes an outer relatively stiff shell 11, a generally annular, flexible headband 12, and an inner liner or suspension, generally designated 13, connecting together the shell and headband.

The shell may be generally conventional, including a generally downwardly facing cupped main portion or crown 15, having its lower edge outstanding, as a brim or lip 16 with the forward region projecting in the manner of a peak 17. At circumferentially spaced locations about the lower region of crown 15 there are provided a plurality of fastener means or connection elements 18, which may be buttons, or other suitable connection elements, as desired. The shell 11 may be suitably molded of plastic, formed of metal, or otherwise fabricated, as desired.

Extending annularly about the lower interior region of the shell crown 15, spacedly therewithin, is the headband 12, which may be of any suitable conventional construction, say constituted of a flexible strip 20 provided with a longitudinally coextensive inner layer or liner 21. The headband 12 may be adjustable, say having overlapping end portions longitudinally adjustable to afford a substantial range of headband sizes.

Figure 3:
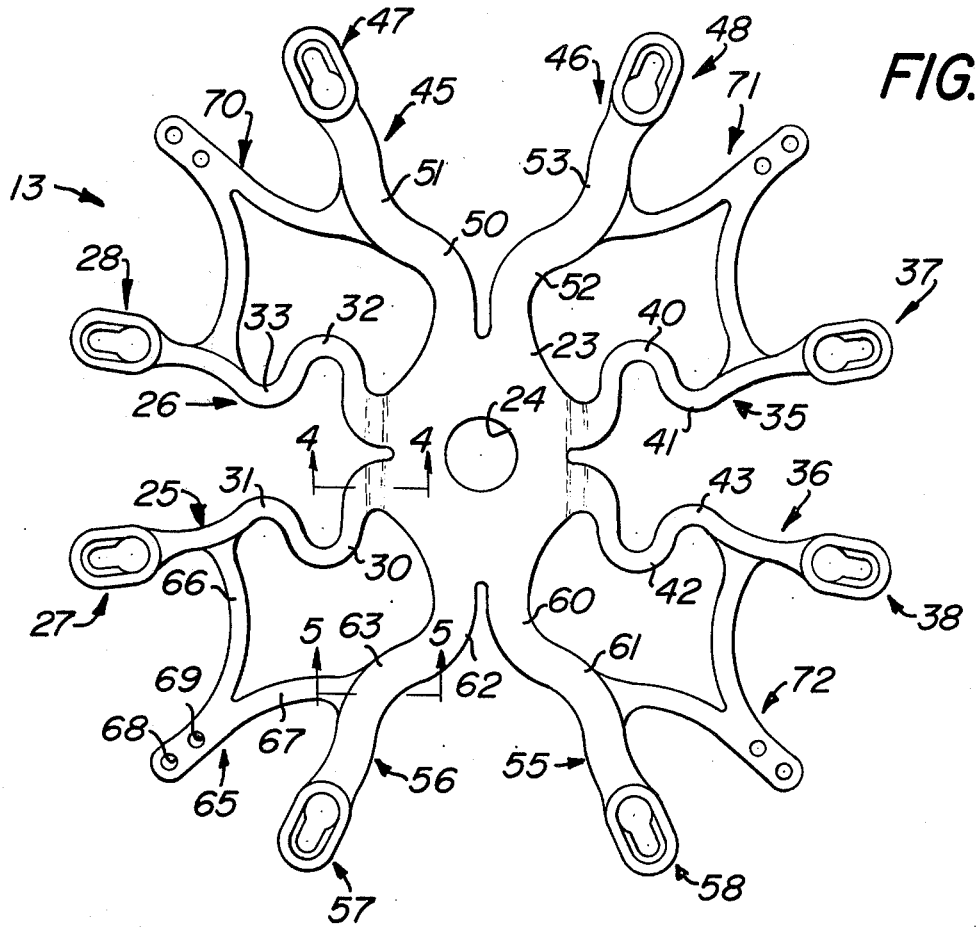
FIG. 3 is a plan view showing a suspension of the present invention apart from a hat.

The suspension or head harness 13 may be integrally molded of suitable material, such as polyethylene plastic, or other, and in its molded condition may be essentially flat, as shown in FIGS. 3, while assuming a domed of cupped configuration in assembly, as shown in FIG. 1.

The head harness or suspension 13 may include a generally flat central portion 23, which may be centrally open, as by a hole 24 for weight and material savings and ventilation.

Figure 4:
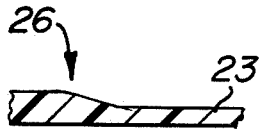
FIG. 4 is a partial sectional view taken generally along the line 4—4 of FIG. 3.

Extending generally radially outwardly from the central portion 23 is an array of legs for end connection to the shell 11 and headband 12. In particular, a pair of adjacent legs 25 and 26 extend generally radially outwardly from one edge region of central portion 23, being provided on their distal ends with connection elements 27 and 28, respectively, which may be configured for mating engagement with fastener elements 18 of the shell 11. The legs 25 and 26 may be substantially identical, but of opposite hand, each being relatively narrow in the plan view of FIG. 3, of relatively sinusoidal configuration as including a pair of relatively short radius of curvature bights, and relatively thick in transverse dimension or thickness, as seen in FIG. 4. In particular, extension or leg 25 may be formed with a pair of generally U-shaped arcuate regions or curves 30 and 31, while being of a thickness greater than that of central portion 23. Similarly, the outstanding extension or radial leg 26 may include a pair of relatively small center of curvature arcuate portions or bights 32 and 33, and is also transversely enlarged or thickened realtive to central portion 23 in the same manner as leg 25. The legs 25 and 26 are adjacent to each other and radiate from the central portion 23 in angularly spaced relation with respect to each other.

Generally opposite to the legs 25 and 26 are a pair of relatively sinusoidal, radially outstanding legs or extensions 35 and 36, which may be identical to each other but of opposite hand, and also identical to the legs 25 an 26. The legs 35 and 36 may each be provided with respective connection means or connector elements 37 and 38, for detachable connection to shell fastener elements 18. The relatively sinuous leg 35 may include a pair of relatively small radius arcuate portions or bights 40 and 41, and similarly the leg 36 may include a pair of relatively small curvature arcuate portions or bights 42 and 43. The legs 35 and 36 are of thickened or increased transverse dimension or depth, relative to the central portion 23, in the same manner as leg 25 of FIG. 4.

While the pair of relatively sinuous legs 35 and 36 are located generally oppositely or on the opposite side of central portion 23 with respect ot relatively sinuous legs 25 and 26, the legs are advantageously arranged in generally diametrically opposed respective pairs. Thus, legs 25 and 35 are substantially diametrically opposed with respect to each other, as for general alignment with each other through central portion 23; and similarly, legs 26 and 36 are substantially diametrically opposed and aligned with each other through the central portion.

By reason of the highly sinuous configuration of legs 25, 26, 35 and 36, and the resilient and yieldable flexibility of the material of the legs, it will be appreciated that there is a substantial degree of longitudinal yieldability and extension under tension. The yielding extensibility is afforded by the flexure of the bights resulting in a straightening and overall elongation. This will occur at all temperatures, being resisted more at low temperatures than high temperatures. To increase high temperature resistance to leg straightening and elongation, there is provided the increased thickness dimension of the sinuous legs shown in FIG. 4.

Extending generally radially outwardly from the central portion 23, on opposite sides thereof, intermediate each pair of relatively sinuous legs 25, 26 and 35, 36 are an additional pair of extensions or legs, being of relatively less sinuous configuration. In particular, extending radially and in angularly spaced relation between more sinuous legs 26 and 35 are a pair of less sinuous legs 45 and 46. The legs 45 and 46 may be essentially identical, but of opposite hand, extending generally radially outwardly from one side of central suspension portion 23 in angularly spaced relation with respect to each other and having arcs or bights of relatively long radius of curvature as compared to the arcs or bights of relatively sinuous legs 25, 26, 35 and 36. The distal ends of legs 45 and 46 are provided with fastener elements, as at 47 and 48, say assuming the form of female fastener elements for mating engagement with shell fastener elements 18.

The less yieldably extensile legs 45 and 46 may be of a thickness approximating that of the central portion 23, and of considerable width as compared to the width of more sinuous legs 25, 26, 35 and 36. Each of the less yieldably extensile legs 45 and 46 may include a pair of arcuate portions or bights, as at 50 and 51 of leg 45 and at 52 and 53 of leg 46. The radii of curvature of bights 50, 51, 52 and 53 may all be equal and advantageously are of greater length than the radii of curvature of bights 30–33 and 40–43 of the more sinuous and yieldably extensile legs, 25, 26, 35 and 36. Thus, the legs 45 and 46 will have some yieldably longitudinal extension under elongating force, as by the physical characteristics of the material and by straightening of the bight portions 50–53. However, the resistance to extension of legs 45 and 46 is greater than resistance to extension of legs 25, 26 and 35, 36. Stated otherwise, the yieldable extensibility of legs 45 and 46 is less than that of legs 25, 26 and 35, 36.

On the opposite side of central portion 23 as less yieldably extensible legs 45 and 46, there are provided an additional pair of less yieldably extensile legs 55 and 56 which may be substantially identical to each other and also to legs 45 and 46. Thus, the legs 55 and 56 may extend radially, be angularly spaced from each other and from adjacent more yieldably extensile legs 25 and 36, being respectively provided with distal end connection elements 57 and 58 for connection to shell fasteners 18. The less yieldably extensile leg 55 may be provided with arcuate portions or bights 60 and 61, and similarly the less yieldably extensile leg 56 may be provided with arcuate portions or bights 62 and 63, all of which may be of a radius of curvature approximately equal to the arcuate portions or bights of legs 45 and 46, being a greater radius of curvature than that of the arcuate portions or bights of legs 25, 26, 35 and 36. The less yieldably extensile legs 55 and 56 are thus yieldably extensile both by longitudinal elongation or straightening of the bight portions 60–63 and by the nature of the material, in the same manner as the legs 45 and 46. Further, it will be appreciated that the legs 45 and 55 are generally diametrically opposed to and in alignment with each other, as are the legs 46 and 56, so as to enhance uniform distribution of force transmitted from the shell 15 to a wearer's head.

Figure 5:
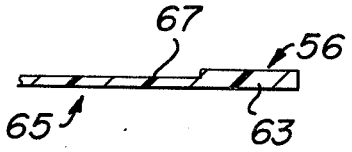
FIG. 5 is a partial sectional view taken generally along the line 5—5 of FIG. 3.

In addition, there are provided a plurality of headband connection legs in a radiant array and angularly spaced about the central portion 23. More specifically, a headband connection leg 65 extends generally radially outwardly with respect to central portion 23, being angularly spaced between legs 25 and 56, and is carried by the central portion through connection to the adjacent legs. That is, a V-shaped formation including arms 66 and 67 extend from intermediate regions of respective legs 25 and 56 to the inner end of connection leg 65. The outer end of leg 65 is provided with one or more through openings or holes 68 and 69 for selective connection to a headband fastener element 64, see FIGS. 1 and 2. The thickness of headband connection legs 65, including its V-shaped portions 66 and 67 is of a reduced dimension as compared to the thickness of central portion 23 and less yieldably estensile legs 45, 46, 55 and 56. This is best seen in the partial sectional view of FIG. 5. It is also there seen, in comparison with FIG. 4, that the more yieldably extensile legs, as at 26, are thicker than the less yieldably extensile legs, as at 56, and that the more yieldably extensile legs are thicker than the central portion 23.

Similar to the headband connection leg 65, there is provided a headband connection leg 70 located in angularly spaced relation between shell connection legs 45 and 26, and connected through the latter to the central portion 23. There is additionally provided a headband connection leg 71 spaced between shell connection legs 46 and 35, and a headband connection leg 72 spaced between head connection legs 36 and 55, both being essentially similar to the hereinbefore described headband connection leg 65.

In the assembled relation, the central pportion 26 is located in an upper central region of the shell 11, the shell connection legs 25, 26, 45, 46, 35, 36, 55 and 56 all extend radially outwardly from the central portion and arcuately downwardly for connection at their outer ends to the shell by the fastener elements 18. In addition, as best seen in FIG. 4, the relatively extensile shell connection legs 25, 26, 35 and 36 extend arcuately downwardly toward generally front and rear regions of the shell 15, and the relatively less yieldably extensile legs 45, 46, 55 and 56 extend arcuately downwardly toward opposite side regions of the shell. It will be observed that the arcuately downward curvature of the more yieldably extensile legs 25, 26, 35 and 36 is of a greater radius of curvature that that of the arcuately downward curvature of the less yieldably extensile legs 45, 46, 55 and 56. By this configuration the more yieldably extensile legs are stressed and elongated upon a downward shell force prior to the less yieldably extensile legs being extended or elongated. A force on the shell 15 is thus transmitted initially through the relatively extensile legs 25, 26, 35 and 36 to the wearer's head, and only if the force is sufficiently great will it be subsequently transmitted through the less yieldably extensile legs 45, 46, 55 and 56, in addition to the more yieldably extensile legs. There is therefore an initial lesser resistance to downward shell force imparted by the more yieldably extensile legs 25, 26, 35 and 36, which is subsequently combined with a greater resistance imparted by the less yieldably extensile legs 45, 46, 55 and 56. If desired, to assure proper operation, the more yieldably extensile legs 25, 26, 35 and 36 may be slightly distended in the assembled condition, without any force applied to the shell. Of course, the headband connection legs 65, 70, 71 and 72 are sufficiently flexible so as not to impair the hereinbefore described force transmission.

In view of the foregoing description, it is believed amply demonstrated that the instant invention provides a hard hat suspension which affords a high degree of shock component dissipation and relatively gradual, uniform and balanced force transmission to a wearer's head, being well adapted for successful use under widely varying environmental conditions, and otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A suspension for a hard hat comprising a central portion for resting on a wearer's head, a plurality of more yieldably extensile legs extending outwardly and arcuately downwardly from said central portion for connection to a hat shell, a plurality of less yieldably extensile legs extending outwardly and arcuately downwardly from said central portion in angularly spaced relation with each other and said more yieldably extensile legs for connection to the hat shell, said more yieldably extensile legs being configured for distension before said less yieldably extensile legs on relative downward shell movement for relatively gradual force transmission to a wearer's head, and a plurality of relatively flexible headband connection legs carried by said central portion and depending freely intermediate said more and less yieldably extensile legs to terminate in free ends for connection to a headband.

2. A suspension for a hard hat according to claim 1, said more yieldably extensile legs being relatively thick compared to said less yieldably extensile legs for reducing high temperature yieldability and being relatively sinuous to afford low temperature yieldability.

3. A suspension for a hard hat according to claim 1, further characterized in said central portion and legs being integrally fabricated of flexibly yieldable plastic material.

4. A suspension for a hard hat comprising a central portion for resting on a wearer's head, a plurality of more yieldably extensile legs extending outwardly and arcuately downwardly from said central portion for connection to a hat shell, a plurality of less yieldably extensile legs estending outwardly and arcuately downwardly from said central portion in angularly spaced relation with each other and said more yieldably extensile legs for connection to the hat shell, said more yieldably extensile legs being configured for distension before said less yieldably extensile legs on relative downward shell movement for relatively gradual force transmission to a wearer's head, and relatively flexible headband connection legs carried by said central portion and depending intermediate said more and less yieldably extensile legs for connection to a headband, said headband connection legs extending from intermediate regions of said more and less yieldably extensile legs for carriage through the same by said central portion.

5. A suspension for a hard hat according to claim 4, said more yieldably extensile legs being of sinuous configuration relative to said less yieldably extensile legs for achieving said more yieldable extension.

6. A suspension for a hard hat according to claim 4, said more yieldably extensile legs being arranged symmetrically generally forwardly and rearwardly for relatively uniform force distribution upon distension thereof.

7. A suspension for a hard hat according to claim 4, each of said more yieldably extensile legs being opposite to another of said more yieldably extensile legs, and each of said less yieldably extensile legs being opposite to another of said less yieldably extensile legs, for balancing force transmission and distension of legs.

* * * * *